US009437142B2

(12) United States Patent
Yang et al.

(10) Patent No.: US 9,437,142 B2
(45) Date of Patent: Sep. 6, 2016

(54) PIXEL CIRCUIT AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Shengji Yang, Beijing (CN); Xue Dong, Beijing (CN); Haisheng Wang, Beijing (CN)

(73) Assignees: BOE Technology Group Co., Ltd., Beijing (CN); Beijing BOE Technology Co., Ltd., Beijing (CN)

( * ) Notice: Subject to any disclaimer, the term of this patent is extended or adjusted under 35 U.S.C. 154(b) by 0 days.

(21) Appl. No.: 14/443,686

(22) PCT Filed: Sep. 26, 2014

(86) PCT No.: PCT/CN2014/087582

§ 371 (c)(1),
(2) Date: May 19, 2015

(87) PCT Pub. No.: WO2015/188519

PCT Pub. Date: Dec. 17, 2015

(65) Prior Publication Data

US 2016/0180774 A1 Jun. 23, 2016

(30) Foreign Application Priority Data

Jun. 13, 2014 (CN) ..... 2014 1 0265700

(51) Int. Cl.
*G09G 3/32* (2016.01)

(52) U.S. Cl.
CPC ..... *G09G 3/3291* (2013.01); *G09G 3/3225* (2013.01); *G09G 3/3266* (2013.01); *G09G 2300/0465* (2013.01); *G09G 2300/0819* (2013.01); *G09G 2320/045* (2013.01)

(58) Field of Classification Search
CPC combination set(s) only.
See application file for complete search history.

(56) References Cited

U.S. PATENT DOCUMENTS 7,119,770 B2 * 10/2006 Moon ..... G09G 3/30 315/169.3
8,547,300 B2 10/2013 Kwak et al.

(Continued)

FOREIGN PATENT DOCUMENTS

CN 1716366 A 1/2006
CN 103474024 A 12/2013

(Continued)

OTHER PUBLICATIONS

International Search Report with Notice of Transmittal of the International Search Report of PCT/CN2014/087582 in Chinese, mailed Mar. 20, 2015.

(Continued)

*Primary Examiner* — Van Chow
(74) *Attorney, Agent, or Firm* — Collard & Roe, P.C.

(57) ABSTRACT

A pixel circuit, comprises two sub-pixel circuits (P1, P2) and a sixth switch unit (T6); a first terminal of the sixth switch unit (T6) is connected to an operating voltage line (Vdd), and a control terminal of the sixth switch unit is connected to a first scan signal line (Em); each of the sub-pixel circuits (P1, P2) comprises five switch units (T1, T2, T3, T4, T5), a driving unit (DT), a energy storage unit (C) and an electroluminescent unit (L), a first switch unit (T1) and a fourth switch unit (T4) in a first sub-pixel circuit (P1) share a scan signal line (Scan[3]) with a first switch unit (T1') and a fourth switch unit (T4') in a second sub-pixel circuit (P2), and a third switch unit (T3) in the first sub-pixel circuit (P1) share a scan signal line (Scan[2]) with a third switch unit (T3') in the second sub-pixel circuit (P2). The pixel circuit completely solves the problem of non-uniformity in the display brightness due to drifting of the threshold voltage of the driving transistor. Meanwhile, one compensation circuit is used to drive two pixels, and two adjacent pixels share multiple signal lines, which can reduce the number of signal lines for the pixel circuit in a display apparatus, lower the cost of the integration circuit, decrease the pixel pitch, and increase the pixel density.

20 Claims, 8 Drawing Sheets

(56) References Cited

U.S. PATENT DOCUMENTS

| | | | | |
|---|---|---|---|---|
| 8,686,927 | B2 | 4/2014 | Kang et al. | |
| 2004/0217932 | A1* | 11/2004 | Nally | G09G 3/2011 345/92 |
| 2005/0052365 | A1* | 3/2005 | Jang | G09G 3/3233 345/76 |
| 2005/0062692 | A1 | 3/2005 | Lo et al. | |
| 2005/0168490 | A1* | 8/2005 | Takahara | G09G 3/2014 345/690 |
| 2007/0152923 | A1* | 7/2007 | Baik | G09G 3/3233 345/76 |
| 2009/0167660 | A1* | 7/2009 | Wang | G09G 3/3637 345/89 |

FOREIGN PATENT DOCUMENTS

| | | | |
|---|---|---|---|
| CN | 104036731 | A | 9/2014 |
| CN | 203882586 | U | 10/2014 |
| JP | 2005025106 | A | 1/2005 |
| KR | 20120044499 | A | 5/2012 |

OTHER PUBLICATIONS

Written Opinion of the International Searching Authority of PCT/CN2014/087582 in Chinese with English translation mailed Mar. 20, 2015.

* cited by examiner

PIXEL CIRCUIT AND DISPLAY APPARATUS

CROSS REFERENCE TO RELATED APPLICATIONS

This application is the National Stage of PCT/CN2014/087582 filed on Sep. 26, 2014, which claims priority under 35 U.S.C. §119 of Chinese Application No. 201410265700.3 filed on Jun. 13, 2014, the disclosure of which is incorporated by reference.

TECHNICAL FIELD OF THE DISCLOSURE

The present disclosure relates to a pixel circuit and a display apparatus.

BACKGROUND

Nowadays, organic light emitting displays (OLED) have become one of the hotspots in the study field of flat panel displays. Compared with liquid crystal displays, OLED has the advantages of low power consumption, low production cost, self light emitting, wide viewing angle and fast response and so on. Currently, OLED has begun to replace the traditional liquid crystal displays (LCD) in the display areas such as mobile-phones, PDAs and digital cameras. Pixel driving circuit design is the core technical content of OLED displays and has important meaning for the study.

OLED is current-driven and needs a stable current to control light emission, which is different from the TFT (Thin Film Transistor)-LCD that uses a stable voltage to control brightness.

Due to process technology, device aging and other reasons, in the original 2T1C driving circuit (comprising two thin film transistors and one capacitor), the threshold voltages of driving TFTs at each pixel are not uniform, which causes changes in the current flowing through the OLED at each pixel so that the display brightness are not uniform, thus affecting the display effect of the entire image.

In the known technology, one pixel circuit generally corresponds to one pixel. Each pixel circuit comprises at least one data voltage line, one operating voltage line and a plurality of scanning signal lines, which causes the corresponding production process more complicated, and not conducive to reducing the pixel pitch.

SUMMARY

In one embodiment of the present disclosure, there is provided a pixel circuit comprising two sub-pixel circuits, each of which comprises a first to a fifth switch units, a driving unit, an energy storage unit and an electroluminescent unit; wherein, a first terminal of the first switch unit is connected to a first terminal of the energy storage unit, a second terminal of the first switch unit is grounded, and the first switch unit is configured to ground the first terminal of the energy storage unit under the control of a scan signal line connected to a control terminal of the first switch unit; a first terminal of the second switch unit is connected to a data voltage line, a second terminal of the second switch unit is connected to the first terminal of the energy storage unit, and the second switch unit is configured to write the voltage in the data voltage line into the first terminal of the energy storage unit under the control of a scan signal line connected to a control terminal of the second switch unit; a first terminal of the third switch unit is connected to the second terminal of the energy storage unit, a second terminal of the third switch unit is grounded, and the third switch unit is configured to ground the second terminal of the energy storage unit under the control of a scan signal line connected to a control terminal of the third switch unit; a first terminal of the fourth switch unit is connected to an output terminal of the driving unit, a second terminal of the fourth switch unit is connected to the second terminal of the energy storage unit, and the forth switch unit is configured to connect the output terminal of the driving unit to a control terminal of the driving unit under the control of a scan signal line connected to a control terminal of the fourth switch unit; a first terminal of the fifth switch unit is connected to the output terminal of the driving unit, a second terminal of the fifth switch unit is connected to the electroluminescent unit, and the fifth switch unit is configured to introduce a driving current provided by the driving unit into the electroluminescent unit under the control of a scan signal line connected to a control terminal of the fifth switch unit; the control terminal of the driving unit is connected to the second terminal of the energy storage unit; in the two sub-pixel circuits, the control terminals of the first switch unit and the fourth switch unit are connected to a third scan signal line, and the control terminals of the third switch unit are connected to a second scan signal line; the control terminals of the second switch unit and the fifth switch unit in a first sub-pixel circuit are connected to a first scan signal line, and the control terminals of the second switch unit and the fifth switch unit in a second sub-pixel circuit are connected to a fourth scan signal line; the pixel circuit further comprises a sixth switch unit, a first terminal of which is connected to an operating voltage line, a second terminal of which is connected to the input terminals of the driving units of the two sub-pixel circuits respectively, and a control terminal of which is connected to a fifth scan signal line, and the sixth switch unit is configured to provide an operating voltage for the driving unit under the control of the fifth scan signal line.

Alternatively, the switch units and the driving units are thin film transistors, the control terminal of each switch unit is a gate of the thin film transistor, the first terminal of each switch unit is a source of the thin film transistor, and the second terminal of each switch unit is a drain of the thin film transistor. The input terminal of said driving unit is a source of the thin film transistor, the control terminal of said driving unit is a gate of the thin film transistor, and the output terminal of said driving unit is a drain of the thin film transistor.

Alternatively, all of the thin film transistors are of P channel type.

Alternatively, the energy storage unit is a capacitor.

Alternatively, the electroluminescent unit is an organic light emitting diode.

In another embodiment of the present disclosure, there is further provided a display apparatus comprising the pixel circuit according to any one of the above.

Alternatively, two sub-pixel circuits of the pixel circuit are located respectively within two adjacent pixels.

Alternatively, the two adjacent pixels are located respectively at two sides of the data voltage line.

Alternatively, the two adjacent pixels are located at a same side of the data voltage line.

In the pixel circuit provided by the embodiment of the present disclosure, the operating current flowing through the electroluminescent unit is not affected by the threshold voltage of the corresponding driving transistor, thus the problem that the display brightness is uneven due to the drift of the threshold voltage of the driving transistor is addressed thoroughly. Meanwhile, the driving of two pixels is accomplished using one compensation circuit, and two adjacent pixels use multiple signal lines in common, which can reduce the number of signal lines for the pixel circuit in the display apparatus and lower the cost of the integration circuit, as well as can shorten the pixel pitch and increase the pixel density.

DETAILED DESCRIPTION

In the following, specific implements of the present disclosure are further described in conjunction with attached drawings and embodiments. The following embodiments are only used for explaining the technical solution of the present disclosure more clearly, but not for limiting the protection scope of the present disclosure.

Figure 1:
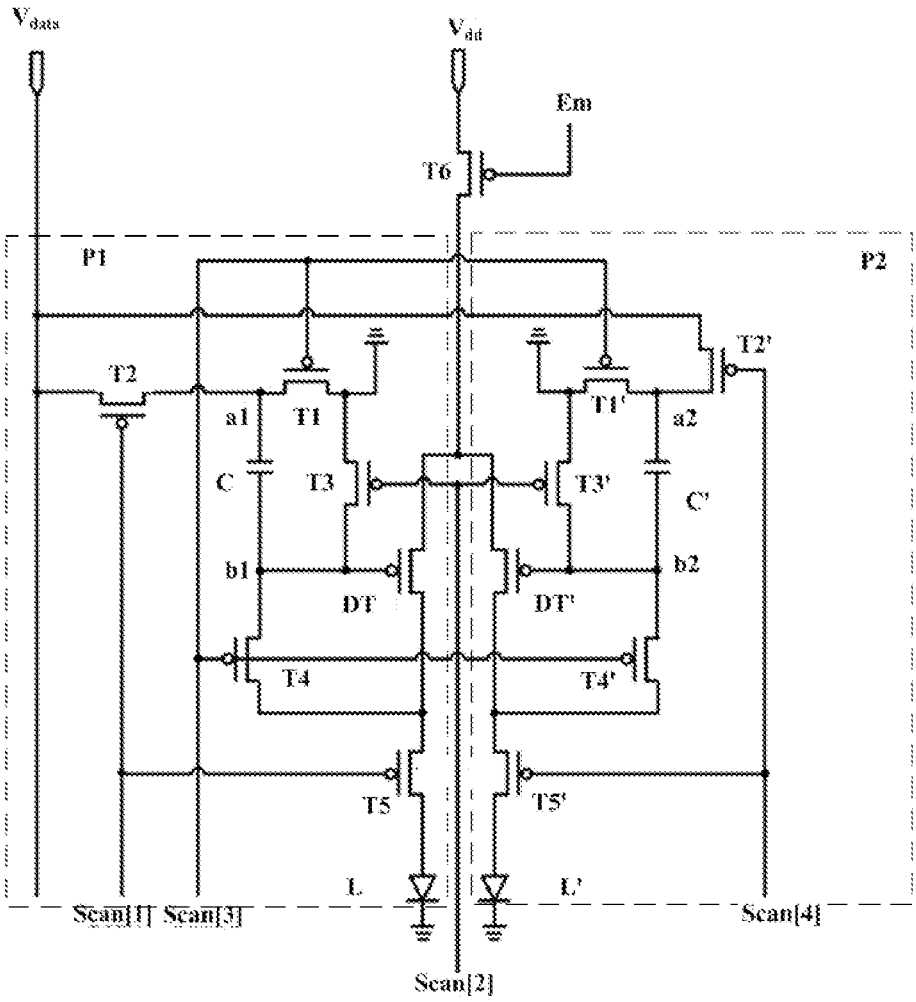
FIG. 1 is a schematic structural diagram of a pixel circuit provided by an embodiment of the present disclosure.

In one embodiment of the present disclosure, there is provided a pixel circuit, as shown in FIG. 1 or FIGS. 3(*a*)-(*e*), comprising two sub-pixel circuits P1 and P2, wherein each of the sub-pixel circuit comprises five switch units T1, T2, T3, T4, T5, one driving unit DT, one energy storage unit C, and one electroluminescent unit L (to facilitate the distinction, in FIG. 1 or FIGS. 3(*a*)-(*e*), the five switch units in P2 are denoted as T1', T2', T3', T4' and T5' respectively, the driving unit is denoted as DT', the energy storage unit is denoted as C', and the electroluminescent unit is denoted as L', the same below); a first terminal of T1 is connected to a first terminal of C, terminal a1, (as shown in the figure, a second terminal of C is terminal b1; for C', a first terminal thereof is terminal a2 and a second terminal thereof is terminal b2), a second terminal of T1 is grounded, and T1 is configured to ground the first terminal a1 of the energy storage unit C under the control of a scan signal line connected to a control terminal of T1; a first terminal of T2 is connected to the terminal a1 of C, a second terminal of T2 is connected to a data voltage line $V_{data}$, and T2 is configured to write the voltage in the data voltage line into the first terminal of the energy storage unit C under the control of a scan signal line connected to a control terminal of T2; a first terminal of T3 is connected to the terminal b1, a second terminal of T3 is grounded, and T3 is configured to ground the second terminal b1 of the energy storage unit C under the control of a scan signal line connected to a control terminal of T3; a first terminal of T4 is connected to an output terminal of DT, a second terminal of T4 is connected to the terminal b1, and T4 is configured to connect the output terminal of the driving unit DT to a control terminal of the driving unit DT under the control of a scan signal line connected to a control terminal of T4; a first terminal of T5 is connected to the output terminal of DT, a second terminal of T5 is connected to L, and T5 is configured to introduce a driving current provided by the driving unit DT into the electroluminescent unit L under the control of a scan signal line connected to a control terminal of T5; the control terminal of the driving unit DT is connected to the terminal b1; in the two sub-pixel circuits P1 and P2, control terminals of T1 and T4 are connected to a third scan signal line Scan[3], and the control terminal of the third switch unit T3 is connected to a second scan signal line Scan[2]; the control terminals of T2 and T5 in a first sub-pixel circuit P1 are connected to a first scan signal line Scan[1]; the control terminals of T2' and T5' in a second sub-pixel circuit P2 are connected to a fourth scan signal line Scan[4]; in addition to the two sub-pixel circuits P1 and P2, the pixel circuit further comprises a sixth switch unit T6, a first terminal of which is connected to an operating voltage line $V_{dd}$, a second terminal of which is connected to input terminals of the two driving units DT and DT', a control terminal of which is connected to a fifth scan signal line Em, and T6 is configured to provide an operating voltage for the driving unit DT under the control of the fifth scan signal line Em.

It can be understood that, in one embodiment of the present disclosure, the plurality of switch units whose control terminals are connected to the same scanning signal line (for example, the four switch units T1, T1', T4 and T4' connected to Scan[3], the two switch units T2, T5 connected to Scan[1], and the two switch units T3 and T3' connected to Scan[2]) should be switches of the same channel type, that is, are all turned on by a high level or all turned on by a low level, thus ensuring the turn-on or turn-off states of the two switch units connected to the same scanning signal line are the same.

In the pixel circuit provided by the embodiment of the present disclosure, the operating current flowing through the electroluminescent unit is not affected by the threshold voltage of the corresponding driving transistor, which completely solves the problem of non-uniformity in the display brightness due to drifting of the threshold voltage of the driving transistor. Meanwhile, one compensation circuit is used to drive two pixels, which narrows down the number of TFT devices for compensation, and reduces the number of data voltage lines by one, thus the number of signal lines. In this way, it is possible to reduce the pixel pitch significantly and lower the IC cost, thus obtaining a higher pixel density.

Alternatively, the switch units and the driving units are thin film transistors (TFTs). The control terminal of each switch unit is a gate of the thin film transistor, the first terminal of each switch unit is a source of the thin film transistor, and the second terminal of each switch unit is a drain of the thin film transistor. The input terminal of each driving unit is a source of the thin film transistor, the control terminal of each driving unit is a gate of the thin film transistor, and the output terminal of each driving unit is a drain of the thin film transistor. Of course, the switch units and the driving units may also be other suitable devices or a combination of the devices.

Further, in an embodiment of the present embodiment, all of the TFTs are of P channel type. By using the same type of transistors, it is possible to unify production process, thereby improving the product yield. The skilled in the art will understand that, in practice, the types of respective transistors may not be identical. For example, T2 and T5 may be a N-channel transistor, while T2' and T5' may be a P-channel transistor. As long as the turn-on/turn-off states of the two switch units whose control terminals are connected to the same scanning signal line are identical, the technical solution provided by the present application can be realized.

The exemplary embodiments of the present disclosure should not be construed as limiting the protection scope of the present disclosure.

Alternatively, the energy storage unit C is a capacitor. Of course, in practice, other elements with energy storage function can also be adopted according to the design requirements.

Alternatively, the electroluminescent unit L can be an organic light emitting diode (OLED). Of course, other elements with electroluminescent function can also be adopted according to the design requirements.

Figure 2:
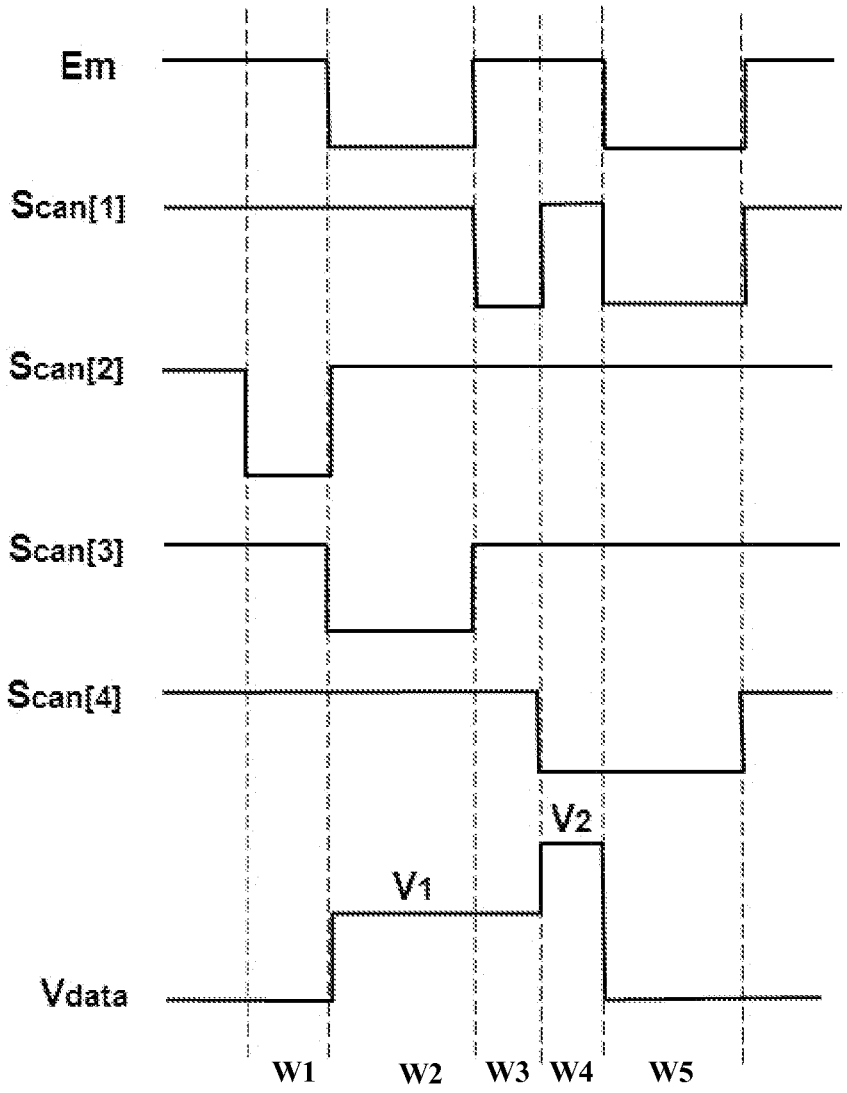
FIG. 2 is a timing chart of critical signals in a pixel circuit provided by an embodiment of the present disclosure.
Figure 3A:
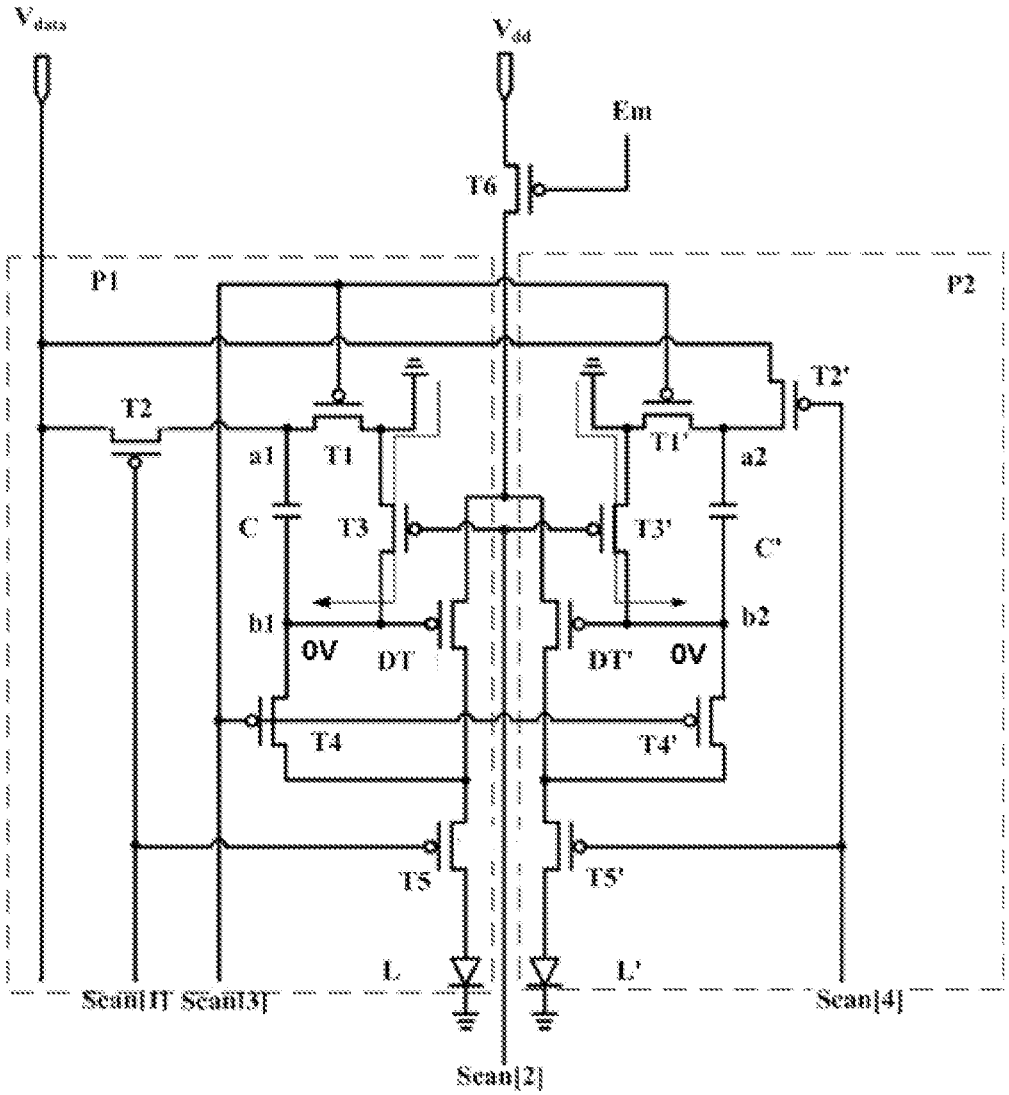
FIGS. 3(*a*) to (*e*) are a schematic diagram of the flowing direction of a current and a voltage value in different timings of a pixel circuit in an embodiment of the present disclosure.
Figure 3B:
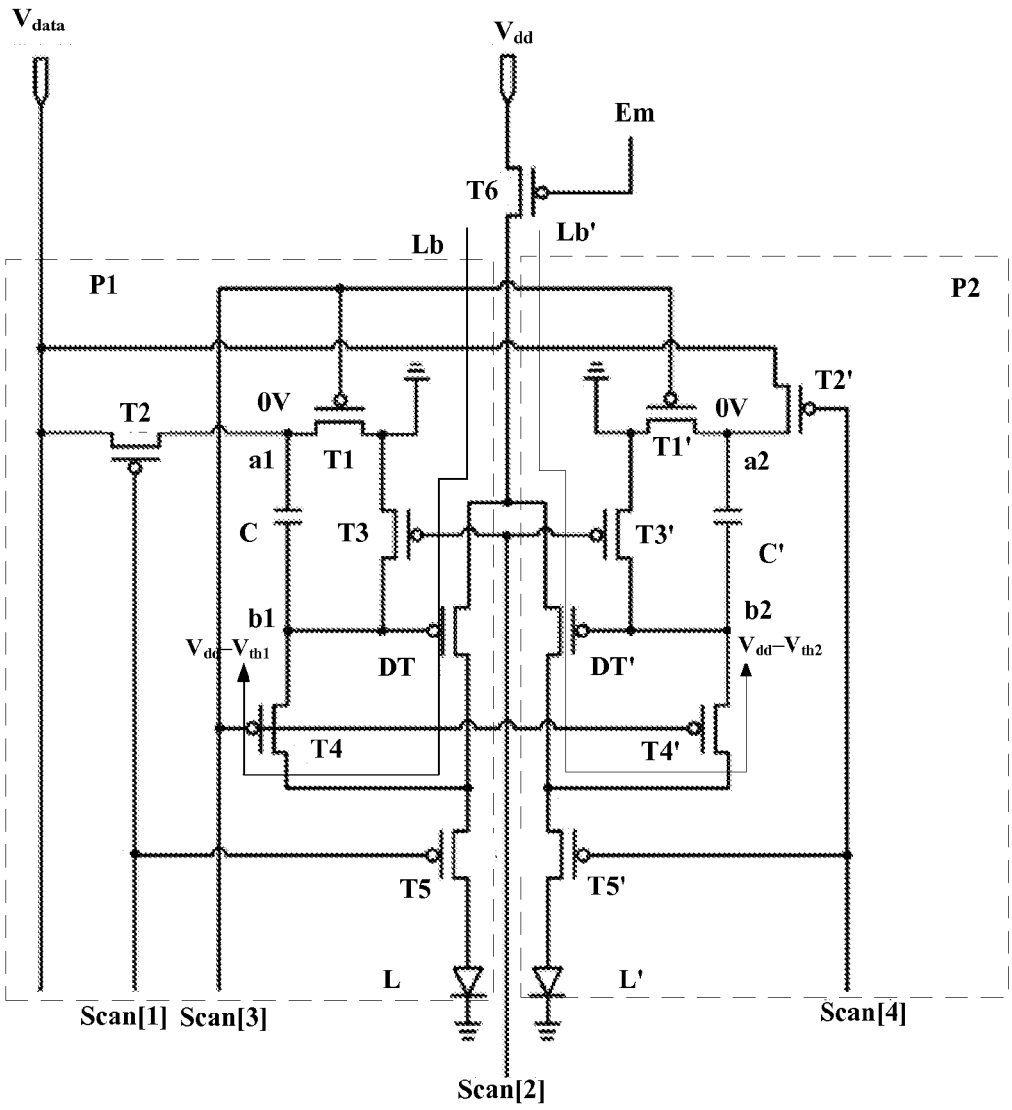
Figure 3C:
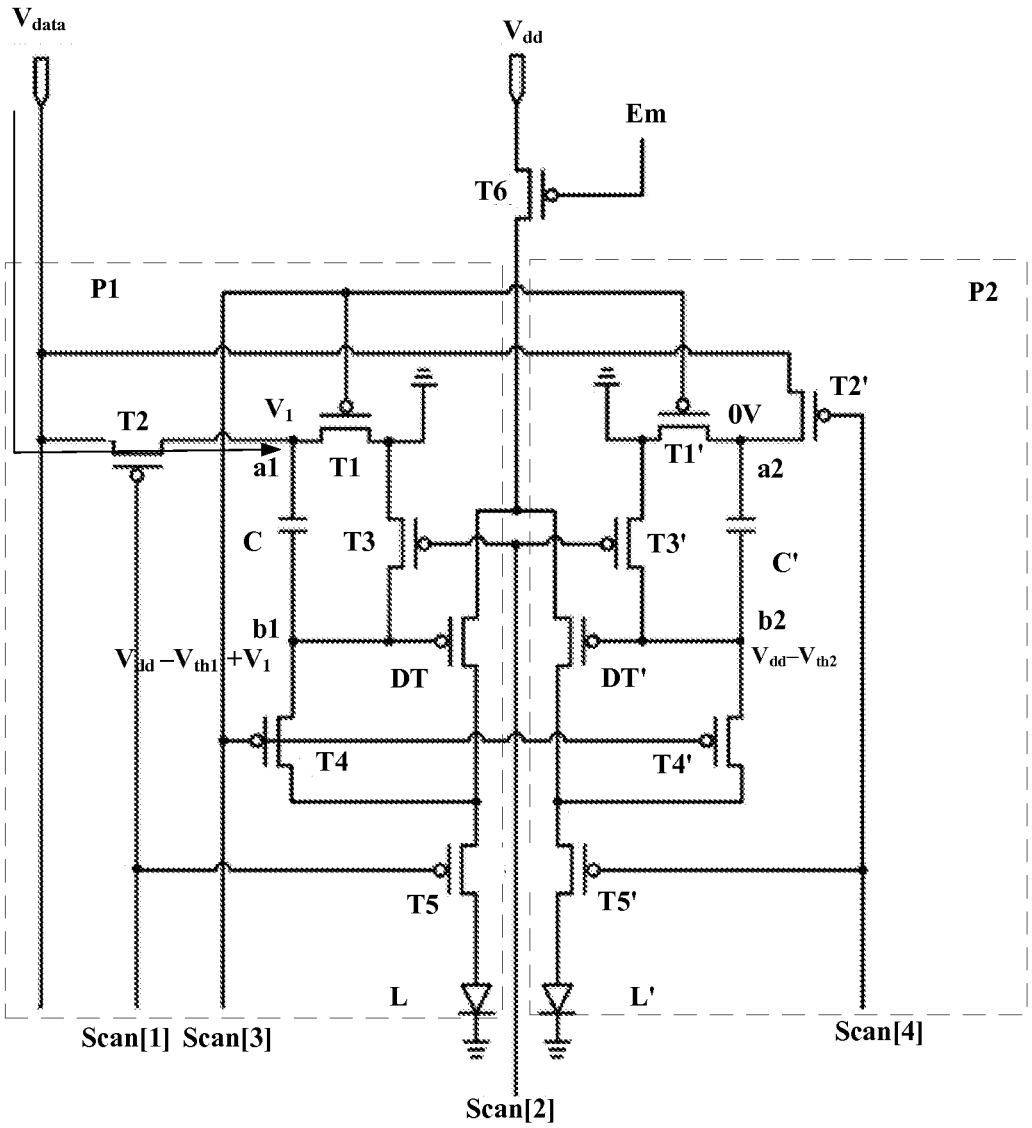
Figure 3D:
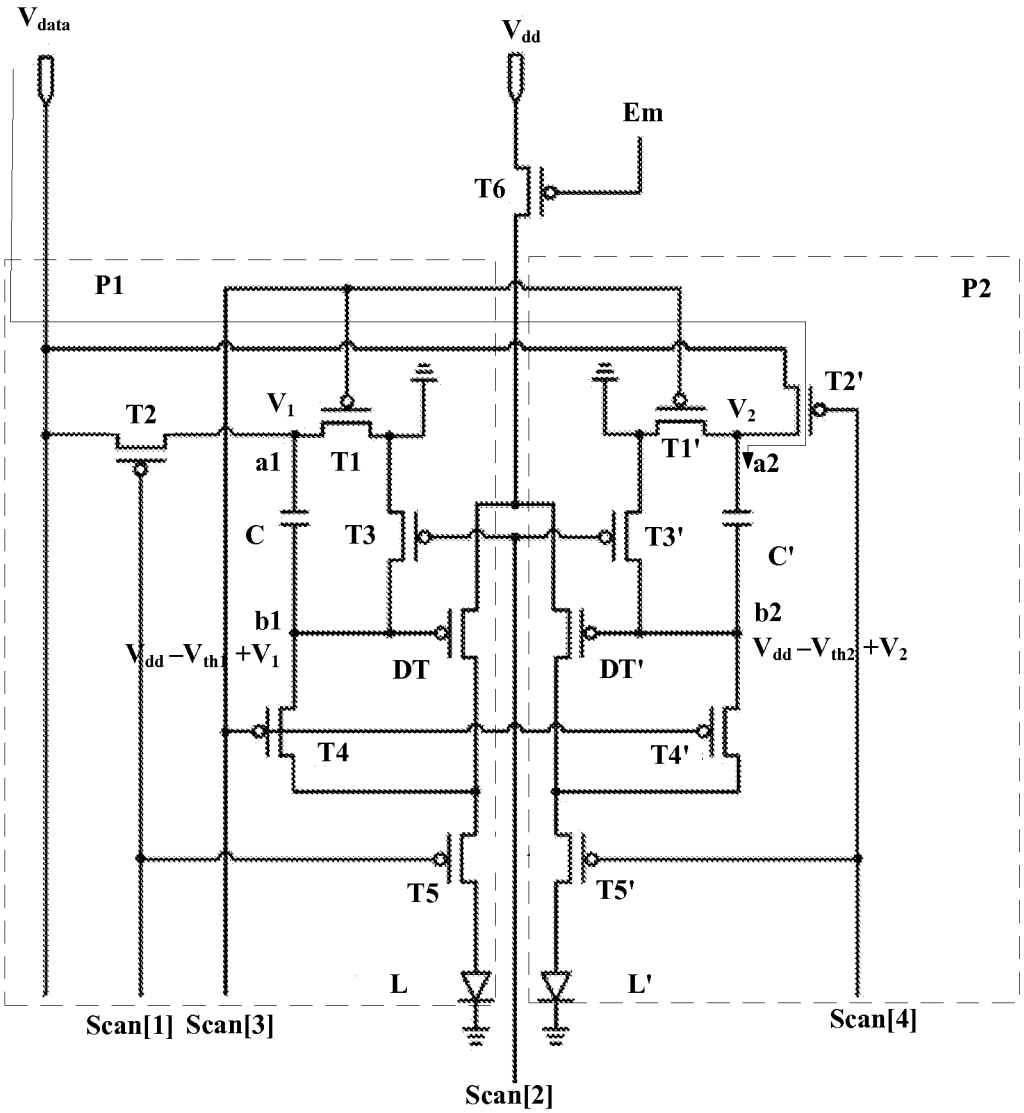
Figure 3E:
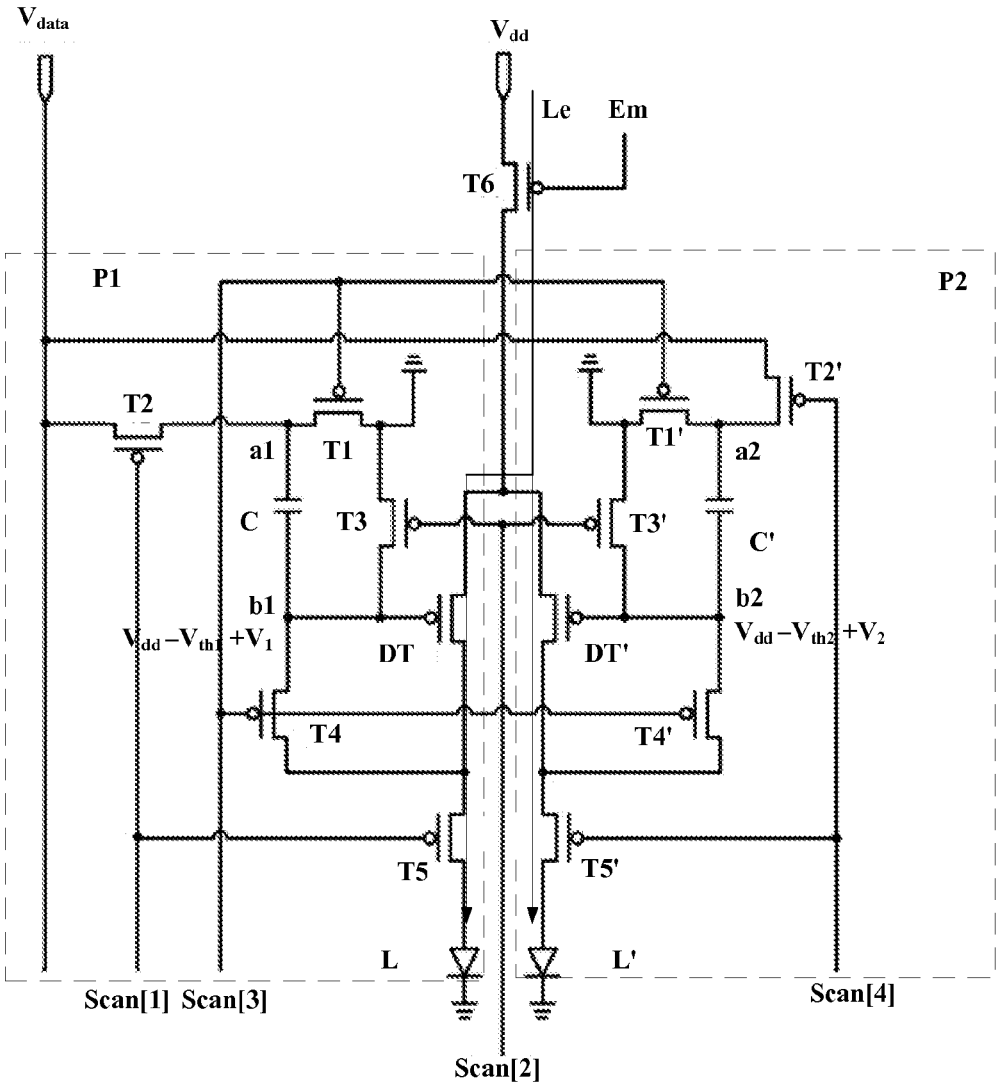

In the following, the detailed explanation of the work principle of the pixel circuit provided by an exemplary embodiment of the present disclosure is made in conjunction with FIG. 2 and FIGS. 3(*a*)-(*e*). FIG. 2 shows a time sequence diagram of scanning signals input into respective scanning signal lines when the pixel circuit provided by the present disclosure is working. It can be divided into five stages, which are respectively represented in FIG. 2 as a reset stage W1, a discharge stage W2, a first pixel compensation stage W3, a second pixel compensation stage W4, and a light emitting stage W5. In each stage, the current flow directions and voltage values of the pixel circuit are shown in FIG. 3 (*a*), FIG. 3(*b*), FIG. 3(*c*), FIG. 3(*d*) and FIG. 3(*e*) respectively. To facilitate explanation, it is assumed that the respective switch units are all TFTs of P channel type.

At the reset stage W1, as shown in FIG. 2, Scan[2] is at a low level, and the other scan signal lines are at high levels. At this time, as shown in FIG. 3(*a*), T3 and T3' are turned on, the other TFTs are all turned off, the terminal b1 of the capacitor C and the terminal b2 of the capacitor C' are grounded at the same time, and the potentials at the two points are 0V.

At the discharge stage W2, as shown in FIG. 2, the Em and Scan[3] are at low levels, the other scan signal lines are at high levels, and $V_{data}=V_1$, with $V_1$ being the voltage corresponding to the light emitting L this time. At this time, T6, T1, T1', T4 and T4' are turned on, the other TFTs are all turned off, and the flowing direction of the current is as shown by Lb and Lb' in FIG. 3(*b*). After the discharge, the potential at point b1 is $V_{dd}-V_{th1}$, and the potential at point b2 is $V_{dd}-V_{th2}$. During this discharge procedure, the current still doesn't flow through the OLED. Points a1 and a2 are grounded, and their potentials are 0V. At this time, the voltage difference between a1 and b1 is $V_{dd}-V_{th1}$, and the voltage difference between a2 and b2 is $V_{dd}-V_{th2}$, with $V_{th1}$ and $V_{th2}$ being the threshold voltages of DT and DT' respectively.

At the first pixel compensation stage W3, as shown in FIG. 2, Scan[1] is at a low level, the other scan signal lines are at high levels, and $V_{data}=V_1$. At this time, T2 and T5 are turned on, and the other TFTs are turned off. As shown in FIG. 3(*c*), at this time, the potential at point a1 is changed into the potential V1 of $V_{data}$, while point b1 is in a floating state. Thus, if the original voltage difference ($V_{dd}-V_{th1}$) between the two points a1 and b1 is to be maintained, an equal-voltage jump will occur in the potential at point b1, and the potential at point b1 will jump to $V_{dd}-V_{th1}+V_1$.

At the second pixel compensation stage W4, as shown in FIG. 2, Scan[4] is at a low level, the other scan signal lines are at high levels, and $V_{data}=V_2$, with $V_2$ being the voltage corresponding to the light emitting L' this time. At this time, T2' and T5' are turned on, and the other TFTs are turned off. As shown in FIG. 3(*d*), at this time, the potential at point a2 is changed into the potential V2 of $V_{data}$, while point b2 is in a floating state. Thus, if the original voltage difference ($V_{dd}-V_{th2}$) between the two points a2 and b2 is to be maintained, an equal-voltage jump will occur in the potential at the gate of DT' (point b1), and the potential at point b2 will jump to $V_{dd}-V_{th2}+V_2$.

At the light emitting stage W5, as shown in FIG. 2, among the scan signal lines, the Em, Scan[1] and Scan[4] are at low levels, and the other scan signal lines are at high levels. At this time, T6, T2, T5, T2', T5', DT and DT' are turned on, and the other TFTs are turned off. $V_{dd}$ supplies a current to L and L' along Le in FIG. 3(*e*) to make L and L' emit light.

It can be known from the saturation current formula that the current flowing through L at this time $I_L=K(V_{GS}-V_{th1})^2=[V_{dd}-(V_{dd}-V_{th1}+V_1)-V_{th1})]^2=K*(V_1)^2$.

Similarly, $I_{L'}=K*(V_2)^2$.

As can be seen from the above formula, at this time, the operating current flowing through the two electroluminescent units is not affected by the threshold voltages of the driving transistors, and is only related to the data voltage $V_{data}$. The problem of threshold voltage ($V_{th}$) drift of the driving TFT due to the process technology and the long-time operation is completely solved, thus eliminating its influence on the current flowing through the electroluminescent unit, and ensuring the normal operation of the electroluminescent unit. Meanwhile, in the embodiment of the present disclosure, two pixels share the same data voltage line and the same operating voltage line, and use only three scan signal lines, thereby reducing the number of the corresponding signal lines significantly, lowering the cost of the integration circuit, decreasing the pixel pitch and increasing the pixel density.

Based on the same conception, in another embodiment of the present disclosure, there is further provided a display apparatus comprising the pixel circuit as shown by any one as described above.

Alternatively, in the display apparatus, the two sub-pixel circuits of the pixel circuit are positioned within two adjacent pixels respectively. In this way, components and parts can be distributed more uniformly on the respective substrates.

Figure 4:
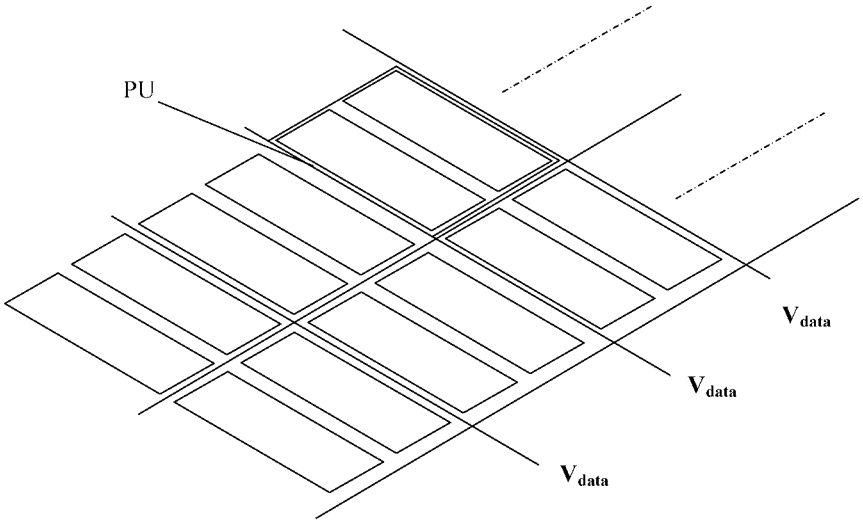
FIG. 4 is a schematic diagram of a position relationship between the pixel circuit and the pixel in a display apparatus provided by an embodiment of the present disclosure.
Figure 5:
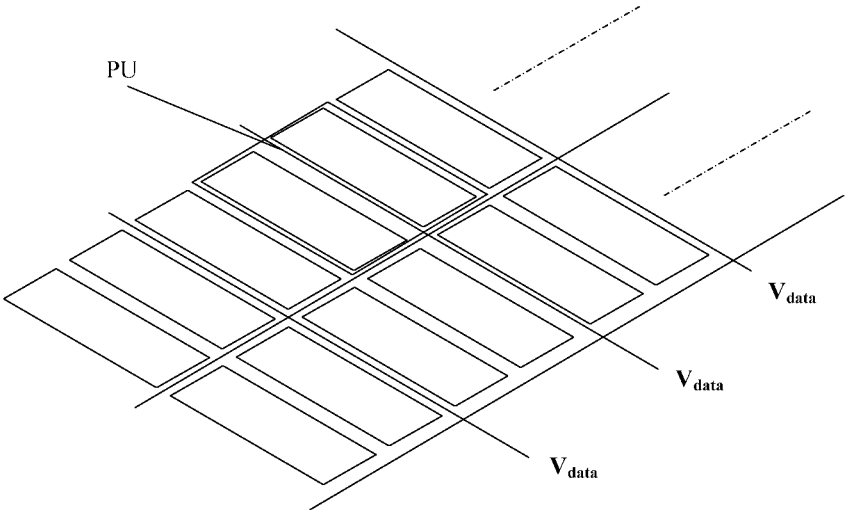
FIG. 5 is a schematic diagram of another position relationship between the pixel circuit and the pixel in a display apparatus provided by an embodiment of the present disclosure.

Alternatively, the two adjacent pixels are positioned on the same side of their data voltage line. FIG. 4 shows a case in which two adjacent pixels corresponding to one pixel circuit PU are at one side of the their corresponding data voltage line $V_{data}$. Alternatively, the two adjacent pixels are positioned on both sides of their data voltage line respectively. FIG. 5 shows a case in which two adjacent pixels corresponding to one pixel circuit PU are at both sides of the their corresponding data voltage line $V_{data}$.

The display apparatus can be any products or means with a display function, such as electronic paper, mobile phones, tablets, televisions, displays, notebook computers, digital photo frames and navigators, etc.

The above descriptions are only preferred implementations of the present disclosure. It should be noted that an ordinary skilled person in the art can also make a number of improvements and modifications without departing from the technical principle of the present disclosure, and these improvements and modifications should also be considered as within the protection scope of the present disclosure.

The present application claims the priority of Chinese Patent Application No. 201410265700.3 filed on Jun. 13, 2014, entire content of which is incorporated as part of the present application by reference.

What is claimed is:

1. A pixel circuit comprising two sub-pixel circuits, wherein each of the sub-pixel circuits comprises a first to a fifth switch units, a driving unit, an energy storage unit and an electroluminescent unit;

a first terminal of the first switch unit is connected to a first terminal of the energy storage unit, a second terminal of the first switch unit is grounded, and the first switch unit is configured to ground the first terminal of the energy storage unit under the control of a scan signal line connected to a control terminal of the first switch unit;

a first terminal of the second switch unit is connected to a data voltage line, a second terminal of the second switch unit is connected to the first terminal of the energy storage unit, and the second switch unit is configured to write the voltage in the data voltage line into the first terminal of the energy storage unit under the control of a scan signal line connected to a control terminal of the second switch unit;

a first terminal of the third switch unit is connected to the second terminal of the energy storage unit, a second terminal of the third switch unit is grounded, and the third switch unit is configured to ground the second terminal of the energy storage unit under the control of a scan signal line connected to a control terminal of the third switch unit;

a first terminal of the fourth switch unit is connected to an output terminal of the driving unit, a second terminal of the fourth switch unit is connected to the second terminal of the energy storage unit, and the forth switch unit is configured to connect the output terminal of the driving unit to a control terminal of the driving unit under the control of a scan signal line connected to a control terminal of the fourth switch unit;

a first terminal of the fifth switch unit is connected to the output terminal of the driving unit, a second terminal of the fifth switch unit is connected to the electroluminescent unit, and the first switch unit is configured to introduce a driving current provided by the driving unit into the electroluminescent unit under the control of a scan signal line connected to a control terminal of the fifth switch unit;

the control terminal of the driving unit is connected to the second terminal of the energy storage unit;

in the two sub-pixel circuits, the control terminals of the first switch unit and the fourth switch unit are connected to a third scan signal line, and the control terminals of the third switch unit are connected to a second scan signal line; the control terminals of the second switch unit and the fifth switch unit in a first sub-pixel circuit are connected to a first scan signal line, and the control terminals of the second switch unit and the fifth switch unit in a second sub-pixel circuit are connected to a fourth scan signal line;

the pixel circuit further comprises a sixth switch unit, a first terminal of which is connected to an operating voltage line, a second terminal of which is connected to the input terminals of the driving units of the two sub-pixel circuits respectively, and a control terminal of which is connected to a fifth scan signal line, and the sixth switch unit is configured to provide an operating voltage for the driving unit under the control of the fifth scan signal line.

2. The pixel circuit according to claim 1, wherein the switch units and the driving units are thin film transistors, the control terminal of each switch unit is a gate of the thin film transistor, the first terminal of each switch unit is a source of the thin film transistor, the second terminal of each switch unit is a drain of the thin film transistor, the input terminal of the driving unit is a source of the thin film transistor, the control terminal of the driving unit is a gate of the thin film transistor, and the output terminal of the driving unit is a drain of the thin film transistor.

3. The pixel circuit according to claim 2, wherein all of the respective thin film transistors are of P channel type.

4. The pixel circuit according to claim 1, wherein the energy storage unit is a capacitor.

5. The pixel circuit according to claim 1, wherein the electroluminescent unit is an organic light emitting diode.

6. A display apparatus comprising the pixel circuit according to claim 1.

7. The display apparatus according to claim 6, wherein two sub-pixel circuits of the pixel circuit are located respectively within two adjacent pixels.

8. The display apparatus according to claim 7, wherein the two adjacent pixels are located respectively at two sides of the data voltage line.

9. The display apparatus according to claim 7, wherein the two adjacent pixels are located at a same side of the data voltage line.

10. The pixel circuit according to claim 2, wherein the energy storage unit is a capacitor.

11. The pixel circuit according to claim 3, wherein the energy storage unit is a capacitor.

12. The pixel circuit according to claim 2, wherein the electroluminescent unit is an organic light emitting diode.

13. The pixel circuit according to claim 3, wherein the electroluminescent unit is an organic light emitting diode.

14. The pixel circuit according to claim 4, wherein the electroluminescent unit is an organic light emitting diode.

15. The pixel circuit according to claim 10, wherein the electroluminescent unit is an organic light emitting diode.

16. The pixel circuit according to claim 11, wherein the electroluminescent unit is an organic light emitting diode.

17. The display apparatus according to claim 6, wherein the switch units and the driving units are thin film transistors, the control terminal of each switch unit is a gate of the thin film transistor, the first terminal of each switch unit is a source of the thin film transistor, the second terminal of each switch unit is a drain of the thin film transistor, the input terminal of the driving unit is a source of the thin film transistor, the control terminal of the driving unit is a gate of the thin film transistor, and the output terminal of the driving unit is a drain of the thin film transistor.

18. The display apparatus according to claim 17, wherein all of the respective thin film transistors are of P channel type.

19. The display apparatus according to claim 6, wherein the energy storage unit is a capacitor.

20. The display apparatus according to claim 6, wherein the electroluminescent unit is an organic light emitting diode.

* * * * *